US006010168A

United States Patent [19]

Johnson

[11] Patent Number: 6,010,168

[45] Date of Patent: Jan. 4, 2000

[54] HIGH SECURITY ROTARY LATCH

[76] Inventor: James B. Johnson, 14211 W. Gilbert Dr., Gregory, Mich. 48137

[21] Appl. No.: 08/747,213

[22] Filed: Nov. 12, 1996

Related U.S. Application Data

[60] Provisional application No. 60/006,548, Nov. 13, 1995.

[51] Int. Cl.[7] ..... E05B 15/02

[52] U.S. Cl. ..... 292/341.17; 292/341.15; 292/207

[58] Field of Search ..... 292/341.17, 340, 292/216, 198, 261, 207, 70, 78, 79, 2, 341.13, DIG. 49, 75; 70/478, 484, 485, 386, 111

[56] References Cited

U.S. PATENT DOCUMENTS

| | | | |
|---|---|---|---|
| 13,722 | 10/1855 | Holmes et al. | 292/198 |
| 448,298 | 3/1891 | Lecellier | 292/198 |
| 936,214 | 10/1909 | Bowes | 292/2 |
| 1,387,156 | 9/1921 | Igo et al. . | |
| 1,657,423 | 1/1928 | Van Duzer | 292/341.17 |
| 2,344,532 | 3/1944 | Brantingson | 292/198 |
| 2,910,859 | 11/1959 | Allen et al. | 292/207 X |
| 3,040,555 | 6/1962 | Wartian | 292/198 X |
| 3,451,704 | 6/1969 | Cothron | 292/198 |
| 3,792,885 | 2/1974 | Giardina et al. . | |
| 3,874,715 | 4/1975 | Beudat | 292/261 |
| 4,240,278 | 12/1980 | Linder . | |
| 4,623,175 | 11/1986 | Carroli . | |
| 4,663,950 | 5/1987 | Mascotte . | |
| 4,691,541 | 9/1987 | McQuade, Sr. | 292/207 X |
| 4,776,189 | 10/1988 | Weber et al. . | |
| 5,096,237 | 3/1992 | Hotzl . | |
| 5,103,658 | 4/1992 | McQuade . | |
| 5,172,944 | 12/1992 | Munich et al. . | |
| 5,184,852 | 2/1993 | O'Brien . | |
| 5,195,448 | 3/1993 | Sims . | |

FOREIGN PATENT DOCUMENTS

| | | | |
|---|---|---|---|
| 1067336 | 10/1959 | Germany | 292/341.17 |
| 2172046 | 9/1986 | United Kingdom | 292/216 |

*Primary Examiner*—Steven Meyers
*Assistant Examiner*—Teri Pham
*Attorney, Agent, or Firm*—Giifford, Krass, Groh, Sprinkle, Anderson & Citkowski, PC

[57] ABSTRACT

A latching or locking mechanism is shown having a rotor mounted for rotation about a longitudinally extending axis, and having detent mechanism cooperating with the rotor to selectively permit a locking of the rotor, or a rotation in the clockwise, or counterclockwise, direction. A recess is provided in the rotor for cooperation with a pawl. When the rotor is locked in position, the pawl is captured in the rotor recess.

3 Claims, 8 Drawing Sheets

HIGH SECURITY ROTARY LATCH

This application is claiming the benefit, under 35 U.S.C. § 119(e) of the provisional application filed on Nov. 13, 1995, under 35 U.S.C. § 111(b), which was granted a Ser. No. 60/006,548. The provisional application, Ser. No. 60/006,548, is hereby incorporated by reference.

BACKGROUND OF THE INVENTION

1. Field of the Invention

The present invention relates to latching and/or locking devices. More particularly, the invention relates to a high security latch or lock. Most particularly, the present invention relates to a high security latch or lock with a cylindrically shaped rotor having a notched portion engageable with a pawl. A flat plane surface on the rotor cooperates with one or more locking rods to permit the rotor to rotate in one, or both, directions selectively, or be locked in position. The device is designed so that any one applying force to the locked rotor will transfer that force to the door jamb in a horizontal direction, rather than a transverse direction, thus providing a high security locking or latching means.

2. Description of the Prior Art

Typically, prior art latches or locks involve a dead bolt moveable in to and out of engagement with a door jamb. A metal strike plate may be mounted to the door jamb. The door jamb is either wood or metal. Any one trying to gain entry to the area which is blocked by the locked door will apply a force to the door. This force is transferred to the dead bolt, and from the dead bolt, in a transverse direction, to a small area of wood or metal forming a part of the door jamb. Since a large amount of force is transferred at a right angle to a relatively small area of the door jamb, a breaking of the door jam, and an entering of the locked premises is easily possible.

Thus, those skilled in the lock art have continued to search for a solution to the problems presented by the prior art locking and latching devices.

SUMMARY OF THE INVENTION

In order to solve the problems in the prior art, an improved latching and/or locking device is provided which transfers force to the door jamb in a parallel or horizontal direction, rather than at a transverse or right angle. Such transfer of force, should it be attempted to open the door, will attempt to spread the entire door jamb, rather than apply the force to a small easily broken area of the door jamb. In order to accomplish this, a rotor is provided having a longitudinally extending axis. The longitudinally extending axis may be in the vertical direction, and the rotor is mounted for rotation about said axis. Detent means are provided which, when engaged, cooperate with said rotor. The rotor engages a pawl which tends to cause the rotor to rotate. The force is transferred from the pawl, by the rotor, to the detent means. The detent means attempt to move in a horizontal direction, thereby changing the transverse force applied to the rotor to a horizonal force applied to the door jamb, which tries to spread the door jamb.

In one embodiment of the invention, a rotor having a longitudinally extending axis, and mounted for rotation about said axis, cooperates with detent means which are selectively operable to permit rotation of said rotor or to block the rotation of said rotor.

In another embodiment of the present invention, a rotor having a longitudinally extending axis, and mounted for rotation about said axis, cooperates with detent means which are selectively operable to permit rotation of the rotor in a clockwise, or a counterclockwise, direction.

In yet another embodiment of the present invention, a latching mechanism is provided which includes a housing having a longitudinally extending axis. A rotor having a longitudinally extending axis parallel to the longitudinally extending axis of said housing is mounted in said housing for rotation about said longitudinally extending axis. Detent means are carried by the housing, and cooperate with the rotor. The detent means are selectively operable to permit rotation of said rotor, or to block the rotation of said rotor.

In still a further embodiment of the present invention, a door assembly is provided which includes a door having a lock mechanism. The lock mechanism includes a rotor having a vertically extending axis mounted for rotation about said vertical axis, and detent means cooperating with the rotor and selectively operable to permit rotation of said rotor or, to block the rotation of said rotor.

Therefore, it is an object of the present invention to provide a high security rotary latch usable in a wide variety of applications.

A further object of the present invention is to provide a high security rotary lock usable in a wide variety of applications. The lock converts any transverse forces applied thereto to a horizontal force.

A further object of the present invention is to provide a high security locking or latching device provided in a door mounted in a door jamb, wherein any attempt to force open the door by application of transverse force thereto is converted to a horizontal force which attempts to spread open the door jamb.

A still further object of the invention is to provide a high security locking device mounted in a door jamb and acting to engage a pawl formed on a door.

A still further object of the present invention is to provide a high security locking device for sliding doors.

A still further object of the present invention is to provide a high security rotary lock for overhead doors.

Further objects and advantages of this invention will be apparent from the following description and appended claims, reference being made to the accompanying drawings forming a part of the specification, wherein like reference characters designate corresponding parts in the several views.

It is to be understood that the present invention is not limited to its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENT

Figure 1:
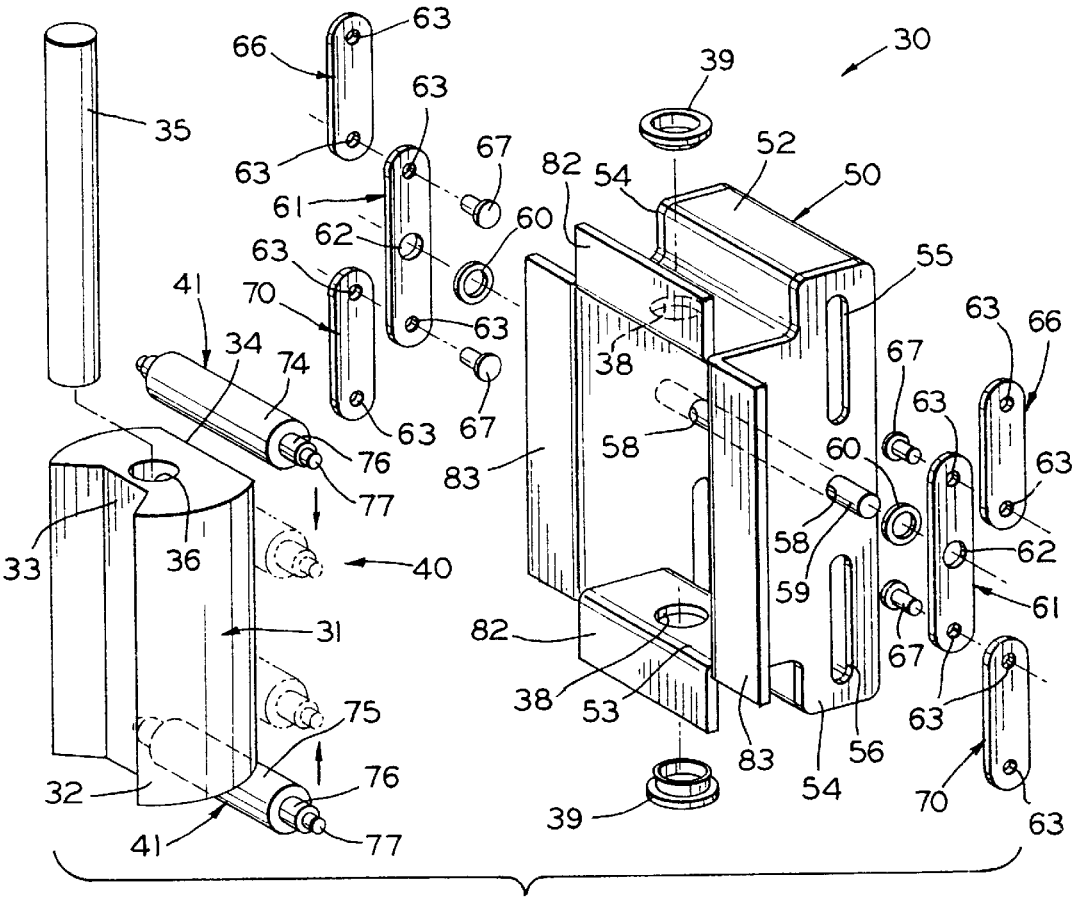
FIG. 1. is an exploded perspective view of a construction bodying the present invention.

Referring now to FIGS. 1–6, the operation of the present invention can be understood. As illustrated in FIG. 1, there is a mechanism, generally designated by the numeral 30. The mechanism includes a rotor assembly 31. Rotor assembly 31 includes a rotor 32 of a generally cylindrical shape, and having a longitudinal axis. The rotor 32 has segmental recess 33, a flat plane surface portion 34, and a longitudinally extending shaft 35 affixed to the rotor 32 in the opening 36.

The axis of the shaft 35 and the rotor 32 may or may not be coaxial. If the axes are not coaxial the rotor will move in an elliptical path when rotated. This would allow the rotor to be further recessed in a housing (to be described) for a more compact design. The rotor may be made from any suitable material to suit the strength requirements of the application. In high security applications, the rotor could be constructed of a material such as steel or aluminum or a material suitable for die casting. The rotor may be manufactured by machining, extruding or die casting.

In lower security applications, the rotor 32 may be made of a polymeric material and manufactured by injection molding or machining.

Detent means 40, which may include such as a pair of transverse rods 41, are moveable into or out of engagement or close proximity with the flat plane surface portion 34 of the rotor 32. In the embodiment of the invention shown in FIG. 1, the transverse rods 41 are moveable vertically into and out of engagement with the rotor 32.

The mechanism 30 may include a housing, generally designated by the numeral 50, having a pair of axially aligned shaft openings 38 in which the shaft 35 is carried for rotation. Bushings 39 may be placed in the shaft openings 38 to provide for easier or predetermined rotation of the shaft 35.

The housing 50 has a top wall 52 and a bottom wall 53 in which the axially aligned shaft openings 38 are provided. The housing 50 also has opposed side walls 54 carrying a first pair of laterally aligned slots 55 and a second pair of laterally aligned slots 56.

The first pair of slots 55 and the second pair of slots 56 may be axially aligned as shown in FIG. 1, or may be off set. Also, it should be understood that in some modifications of the present invention, only one pair of laterally aligned slots may be used.

Also carried by the opposed side walls 54 is a pair of transverse shaft openings 58 in which is carried for selective rotation a lock shaft 59. Spacer washers 60 are placed over each end of the lock shaft 59 and a first link 61, having shaft opening 62, and pin opening or apertures 63, is fixedly mounted to each end of lock shaft 59 for rotation therewith.

The detent means 40, in the embodiment of the invention shown in FIG. 1, include a pair of transverse rods 41 including a first or upper horizontal rod 74 and a second or lower horizontal rod 75. At each end of the upper rod 74 and the lower rod 75 are a shaft portion 76 and a reduced or connecting portion 77. The lower extremity of each of a pair of third links 70 is connected through opening 63 to the reduced or connecting portion 77 at each end of the second or lower horizontal rod 75.

In a like manner, the upper extremity of each of a pair of second links 66 is connected through opening 63 to the reduced portion 77 of the shaft portion 76 at each end of the first or upper horizontal rod 74. It can be seen that in FIG. 3 the transverse rods 41 forming a portion of the detent assembly are shown in their maximum, spaced apart or extended position, and that the first links 61, second links 66 and third links 70 are in a vertical position. In this position, the transverse rods 41 are out of close proximity or engagement with the flat plane surface portion 34 of the rotor 32, and rotor 32 is free to rotate until the flat plane surface portion 34 of the rotor strikes the lock shaft 59.

It should be understood that, normally, the diameter of the transverse rods 41 will be substantially larger than the lock shaft 59. This will permit enough rotation of the rotor 32 such that the side walls 37 of the segmental recess 33 may rotate to a position flush with the side of the housing (FIG. 5) to permit the pawl, to be described, to freely move out of engagement with the rotor.

It can easily be understood by those skilled in the art that to achieve the necessary rotation of the rotor, the transverse shaft openings 58 in the opposed side walls 54 of the housing 50 need not be in axial alignment with the first pair and second pair of laterally aligned slots (55, 56). Further, the lock shaft 59 does not need to extend between the side walls 54, but could comprise a pair of stub shafts if desired. Alternately, horizontal notche(s) (not shown) could be placed in rotor 32, proximate lock rod 59.

Figure 4:
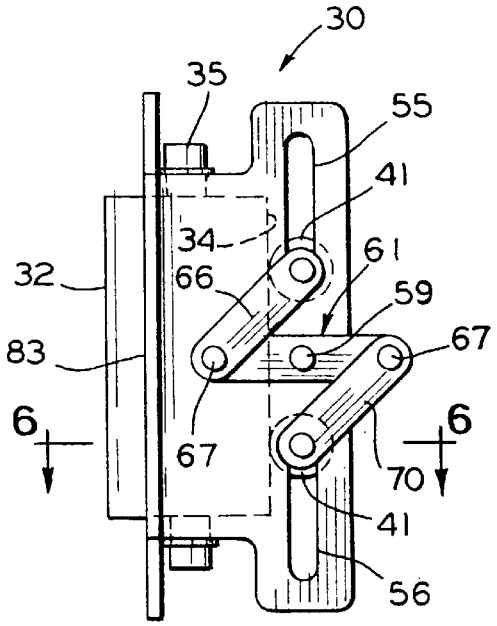
FIG. 4 is a view similar to FIG. 3 with the detent means engaged.

Also, it can be understood that while the transverse shafts 41 shown in FIG. 4 are shown as being in actual contact with the flat plane portion 34 of the rotor 32, some "play" is permissible. It is only necessary that the shafts 41 come in close proximity to the flat plane portion 34 and provide sufficient blockage such that the proper degree of retention is provided for the rotor 32. The transverse rods 41 only need to be in close proximity to the flat plane surface portion 34 of the rotor 32 to block the rotor from rotation.

Figure 2:
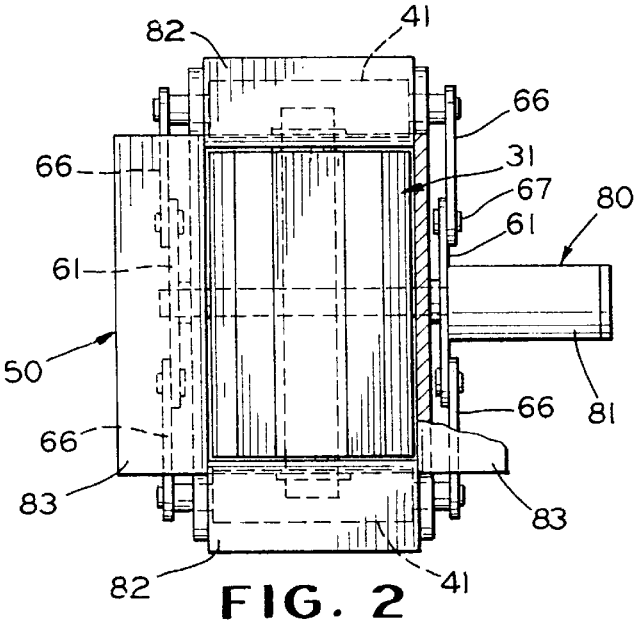
FIG. 2 is a front elevational view of the construction shown in FIG. 1, and including a lock means.
Figure 3:
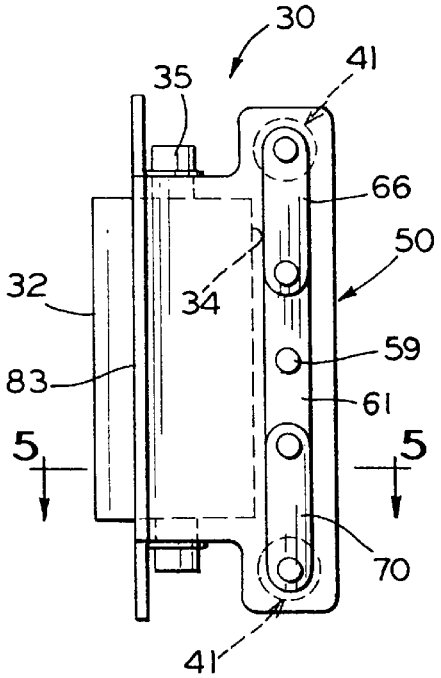
FIG. 3 is a right side elevational view of the construction shown in FIG. 1 with the detent means disengaged.

With reference to FIG. 2 it can be seen that the detent means 40, which includes the transverse rods 41, the first links 61, the second links 66, and third links 70, all connected by pins 67, may be connected to a lock means generally designated by the numeral 80, which may include such as the lock cylinder 81. Lock cylinder 81 may be operated by a key (not shown). It can be understood that the lock means may take many forms, such as a key operated lock means, a combination operated lock means, or any other practical lock means, and be well within the scope of the present invention as long as a rotational force is applied to the lock shaft 59.

The linkage (61,66,70) may connect to any suitable means to transmit the desire to lock or unlock the door. Such lock means may range from a key lock to other actuation devices, such as a knob, to urge the lock rods 41 from their unactuated or unlocked position to their actuated or locked position. The first links 61 and the second links 66 may be joined together by other than the pin means 67 and still be well within the scope of the present invention.

A pair of horizonal flanges 82, and a pair of vertical flanges 83 may be provided at the front of the housing 50 for mounting the housing in a suitable opening in a door or a door jamb.

Figure 5:
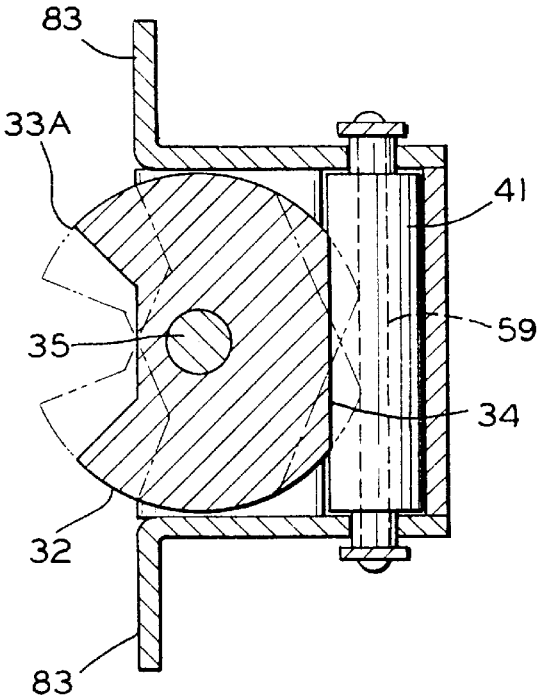
FIG. 5 is a sectional view, taken in the direction of the arrows, along the section line 5—5 of FIG. 3.
Figure 6:
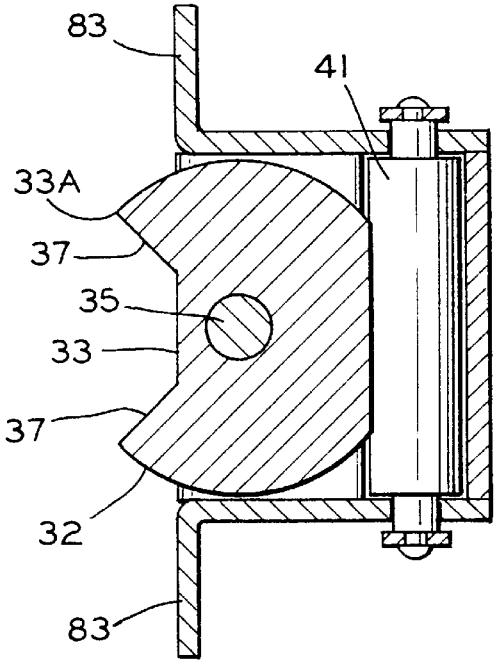
FIG. 6 is a sectional view, taken in the direction of the arrows along the section line 6—6 of FIG. 4.

Referring to FIGS. 5 and 6, it can be seen that when the detent means 40 are disengaged, and the transverse rods 41 are out of locking engagement with the rotor 32, the rotor 32 may turn freely in both directions until the flat plane surface portion 34 contacts the lock rod 59 which, for ease of understanding, is shown in dotted lines in FIG. 5. The dimensions may be chosen such that the lip 33A of the segmental recess 33 is substantially flush with the vertical flange 83 to permit disengagement of the pawl means (not shown in FIG. 5) from the rotor 32 in either direction.

Figure 7:
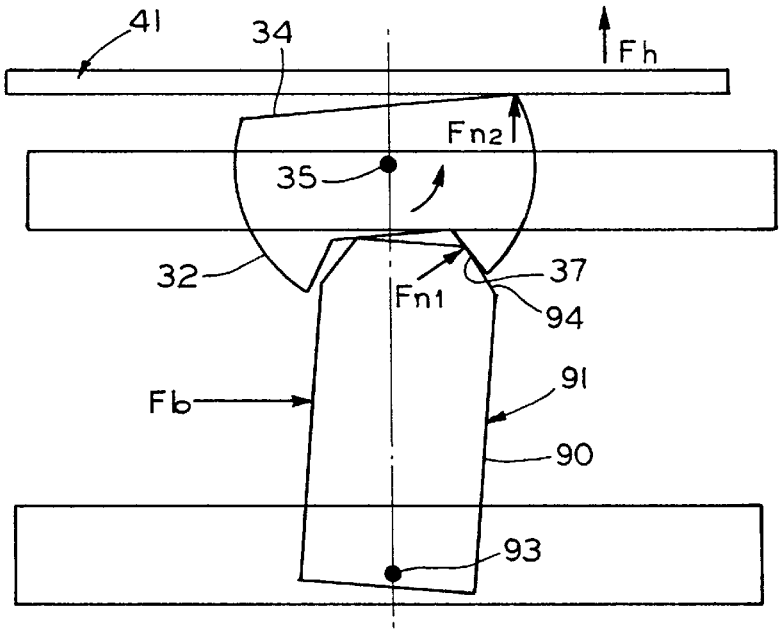
FIG. 7 is a force diagram showing how the application of a transverse force to a door is transferred to a horizontal force acting against a door jamb.

Referring to FIG. 7, the theory of operation of the present invention may now be understood. Anyone attempting unauthorized entry to a space closed by the door 90, which in the illustration of FIG. 7 also serves as the pawl means 91, will transversely apply a breaking force of $F_B$ to a face of the door 90. This will cause a slight rotation of the door 90 about the hinge point 93, and a contacting of the pawl face 94 with the side wall 37 of segmental recess 33. The dimensions and angles involved have been chosen such that the force between the pawl face 94 and the side wall 37 are substantially normal, as indicated by the arrow labeled $F_{N1}$. The force $F_{N1}$ has caused a rotation of the rotor 32 about the shaft 35, and has caused the flat plane portion 34 of the rotor 32 to come into contact with one or more of the transverse rods 41. Since there is a line to surface contact at the point of contact between the flat plane portion 34 and the transverse rod 41, again the force is in a normal direction, as indicated by $F_{N2}$. The force $F_{N2}$ is in a horizontal direction, tending to push the transverse rod 41 side ways or horizontally into the door jamb or wall as indicated by the force $F_H$. The more force $F_B$ is applied to the door, the more horizontal force is applied to the door jamb $F_H$. Thus, attempting to force the lock means of the mechanism 30 requires the spreading of an entire door frame or door jamb rather than just breaking of a small area of wood in the door jamb, such as in prior art devices.

It can be understood that the pawl means 91 can be any object whose sides taper at approximately complimentary angles to that of the angles that define the segmental recess 33 of the rotor 32 over a sufficient distance to provide engagement with said segmental recess 33. In the case of the housing 50 mounted in the door jam (described below) the pawl is securely mounted to the shut face of the door. The pawl means 91 may also be an integral part of the door by forming the edge of the door in the configuration of the pawl in the area that corresponds to the rotor if the housing 50 is mounted in a door. The pawl is made from a suitable material to suit the strength requirements of the application. As before, in high security applications, the pawl means 91 could be constructed of a material such as steel or aluminum or a material suitable for die casting. The pawl may be manufactured by machining extruding or die casting. In lower security applications the pawl means 91 may be made of a polymeric material manufactured by injection molding or machining.

Figure 8:
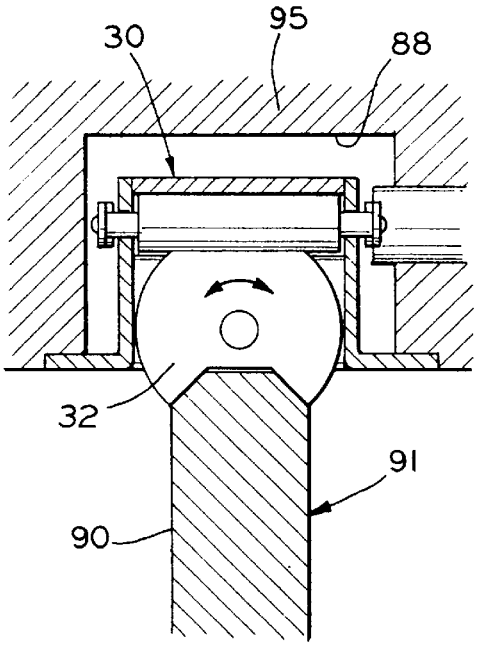
FIG. 8 is a plan view, partly in section, showing a construction embodying the present invention mounted in a door jamb and, engaging a door.
Figure 9:
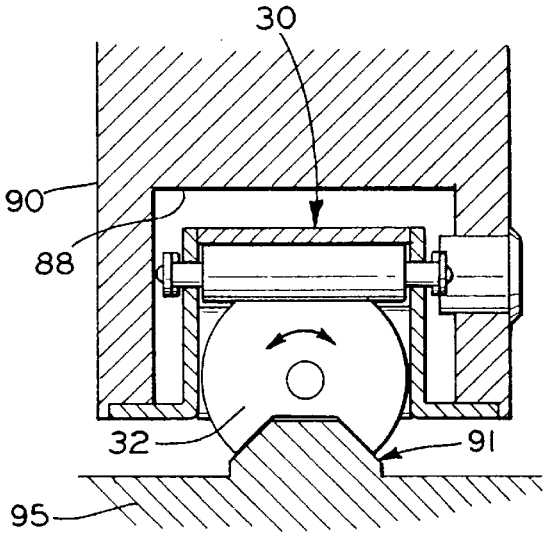
FIG. 9 is a top plan view, partly in section, showing a modification of the present invention mounted in a door, and engaging a pawl mounted on a door jamb.

Referring to FIGS. 8 and 9, the great versatility of the present invention can be seen. In FIG. 8 the latching or locking mechanism 30 of the present invention is mounted in a recess 88 in a door jamb 95. The pawl means 91 is formed on at least a portion of a door 90.

In contrast, in FIG. 9 the pawl means 91 constitutes at least a portion of a door jamb 95, and the locking or latching mechanism 30 of the present invention is mounted in a recess 88 of a door 90.

Figure 10:
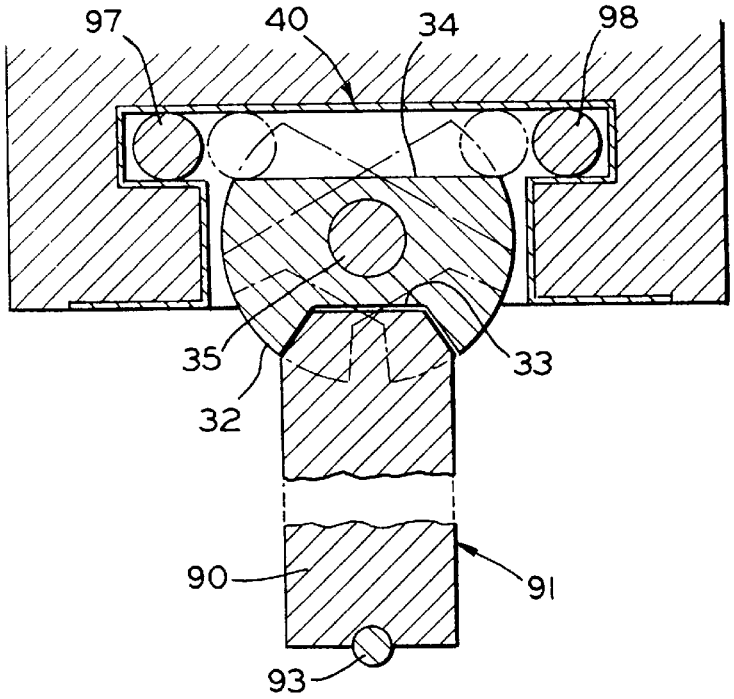
FIG. 10 is a top plan view, partly in section, showing a modification of the present invention wherein a pair of vertical rods are used to either block, or selectively allow, rotation of the rotor in one direction or another.
Figure 11:
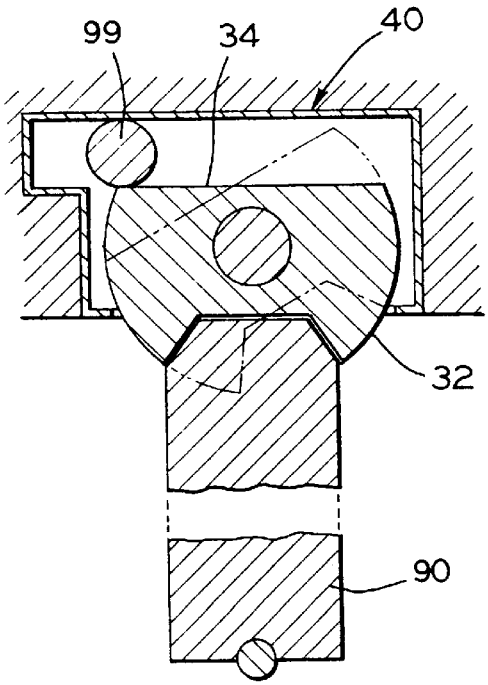
FIG. 11 is a elevational view, similar in part to FIG. 10, and showing the use of a single vertical rod to block rotation of the rotor in one direction only.

Referring to FIGS. 10 and 11, further modifications of the present invention can be seen. Whereas, in all previous versions of the invention, the detent means 40 were shown including transverse rods 41, in the modification shown in FIGS. 10 and 11, the detent means 40 include vertical rods (97–99). As before, the latching or locking function of the resent invention is performed by capturing a pawl means 91 in a segmental recess or other type recess 33 within the rotor 32. The rotor 32 rotates about a longitudinal axis about a shaft 35. In this instance, however, a pair of vertical rods (97,98) are provided for selective engagement with the flat plane surface 34 of the rotor 32. If the first vertical rod 97 is moved laterally into engagement with the flat plane surface 34 of the rotor 32, the rotor 32 will be free to rotate counterclockwise only, letting the pawl means 91 or door 90 open in only one direction.

If, however, the first vertical rod 97 is left in its retracted position, as shown in heavy dark lines, and the second vertical rod 98 is moved into engagement with the flat plane surface portion 34 of the rotor 32 the rotor 32 can only rotate in a clockwise direction, which means the door 90 or pawl means 91 can only rotate in a counterclockwise direction. The first rod 97 and the second rod 98 can selectively be moved into engagement with the rotor 32 by any means well known in the art.

A still further modification of the present invention is shown in FIG. 11, wherein the detent means 40 includes a single vertical rod 99 in removable engagement with the flat plane surface 34 of the rotor 32. This version of the present invention is used where only a one way opening of the door 90 is desired.

Figure 12:
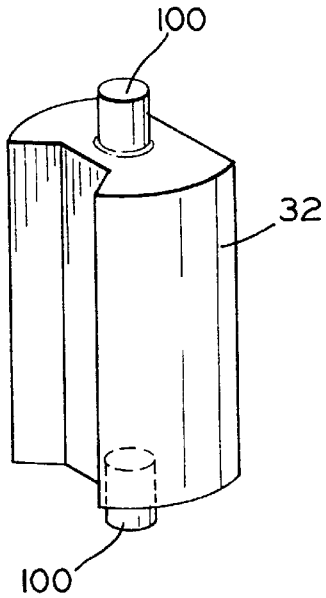
FIG. 12 is a perspective view showing a modification of the rotor shown in FIG. 1.

As can be seen in FIG. 12, the shaft on which the rotor 32 is supported for rotation, need not be a solid shaft, but could be a pair of stub shafts 100, either mounted to or formed integrally with the rotor 32. Any practical way of providing a shaft is well within the scope of the present invention.

Figure 13:
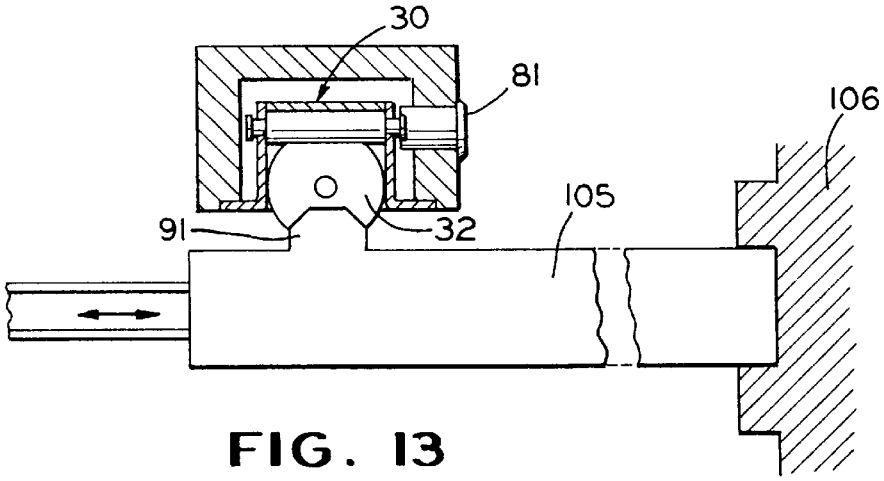
FIG. 13 is a plan view, partly in section, showing an embodiment of the present invention which may be used to secure a sliding door.

Referring now to FIG. 13, there is shown a modification of the present invention which is useful with sliding doors, such as door 105 which cooperates with door jamb 106. The mechanism 30 of the present invention is mounted in a suitable fashion to engage a pawl means 91 mounted on a sliding door 105. A lock cylinder 81 may be provided for locking the rotor 32 in position. If the pawl means 91, for example, extended the full height of the sliding door 105, and the mechanism 30 was provided, for example, in an adjacent door panel or as part of a building structure, any attempt to slide open the door 105 would result in a force tending to move the mechanism 30 transversely from the door 105, and this force would be spread over the entire height of the door. Any attempt at opening the sliding door 105 would be very difficult.

Figure 14:
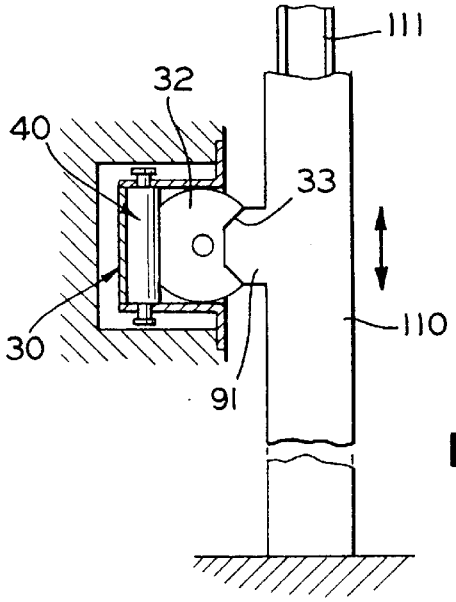
FIG. 14 is an elevational view, partly in section, showing a modification of the present invention which may be used to secure an overhead door.

Referring to FIG. 14, the mechanism 30 of the present invention is shown in an embodiment suitable for use with an overhead door, such as a garage door 110, operating in the track 111, well known in the art. A pawl means 91 is provided on the garage door 110, which engages the segmental recess 33 in the rotor 32. As before, the rotor 32 is selectively locked or unlocked by the detent means 40.

Figure 15:
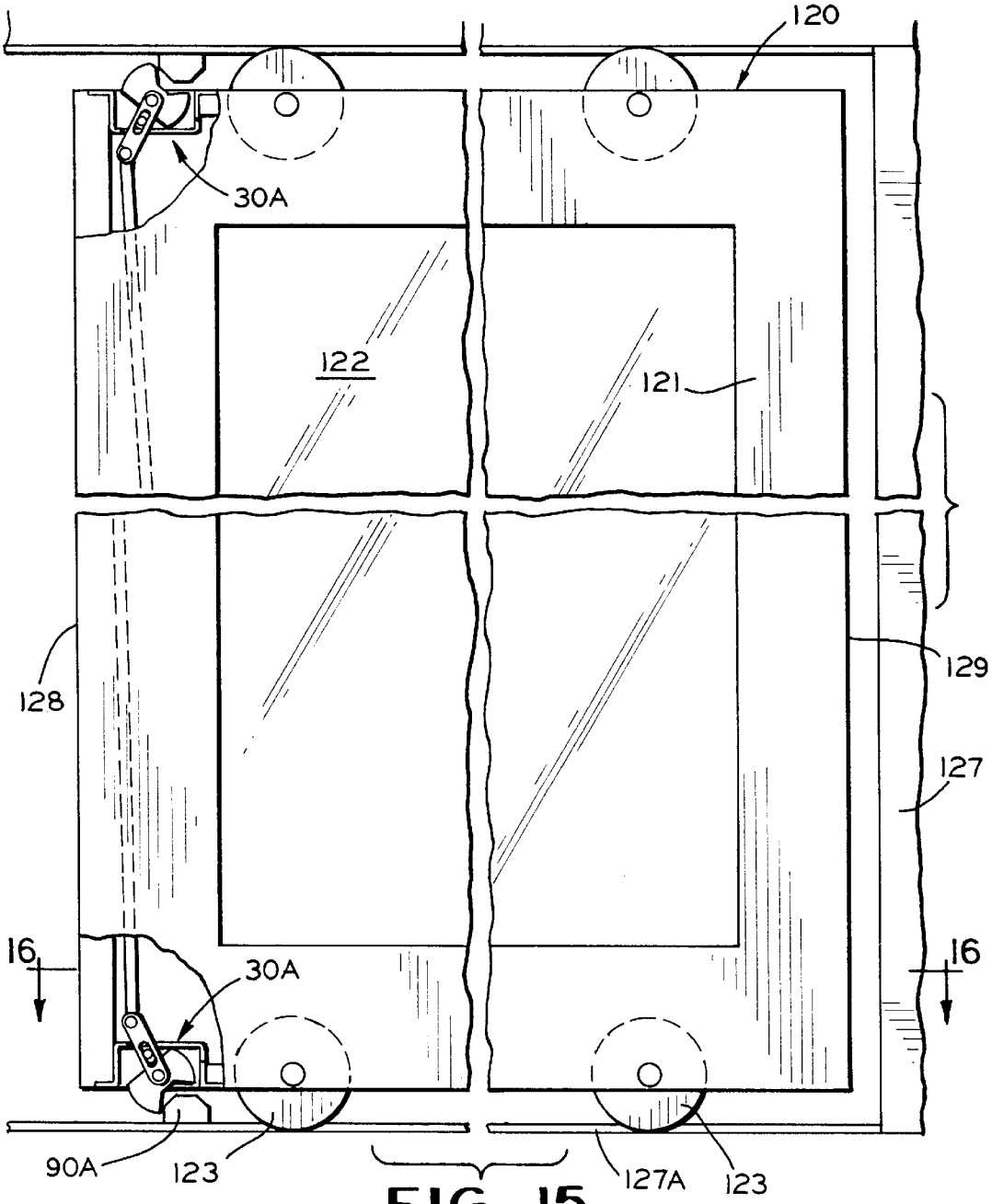
FIG. 15 is an elevational view showing a further modification of the present invention which may be used to secure a sliding door.
Figure 16:
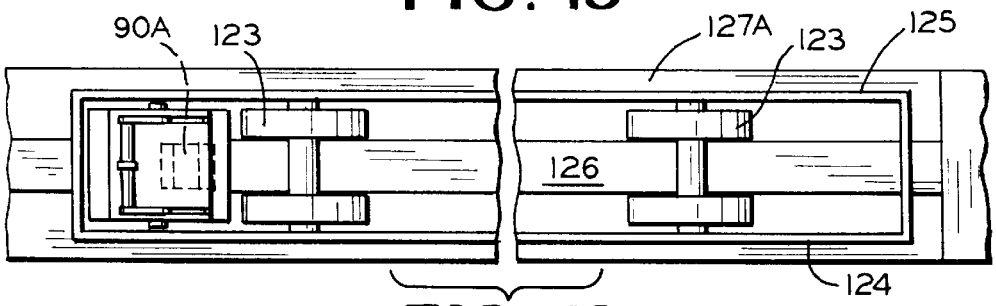
FIG. 16 is a sectional view, taken in the direction of the arrows, along the section line 16—16 of FIG. 15.

A further modification of my invention, particularly suitable for providing high security for a sliding door, is shown in FIGS. 15 and 16. A sliding door 120 having a door frame 121 forming four sides thereof, and enclosing the transparent or window portion 122, moves on a pair of rollers 123 mounted between the front side 124 and the rear 125 of the door in a hollow portion thereof. The wheels or rollers 123 straddle a track portion 126 provided at the bottom 127A of the door jam or opening 127. In this modification of my invention, a pair of modified lock mechanisms 30A are mounted at the top and the bottom of the door 120 in an aligned 180° opposed relationship. The lock mechanisms 30A may be mounted proximate the rear edge 128 of the door 120 as shown, or proximate the opposite or leading edge of the door 129.

In this modification of the invention, the longitudinal axis of the modified lock mechanism 30A, and the modified rotor 32A are parallel and may be coincident. Whether parallel or coincident, they are transverse to the path of movement of the sliding door 120 along the track 126. As shown, the pawl 90A is of a width less than or equal to the width of the track 126 so that the wheels or rollers 123 may pass over the pawl 90A when the sliding door 120 is open and closed.

Figure 17:
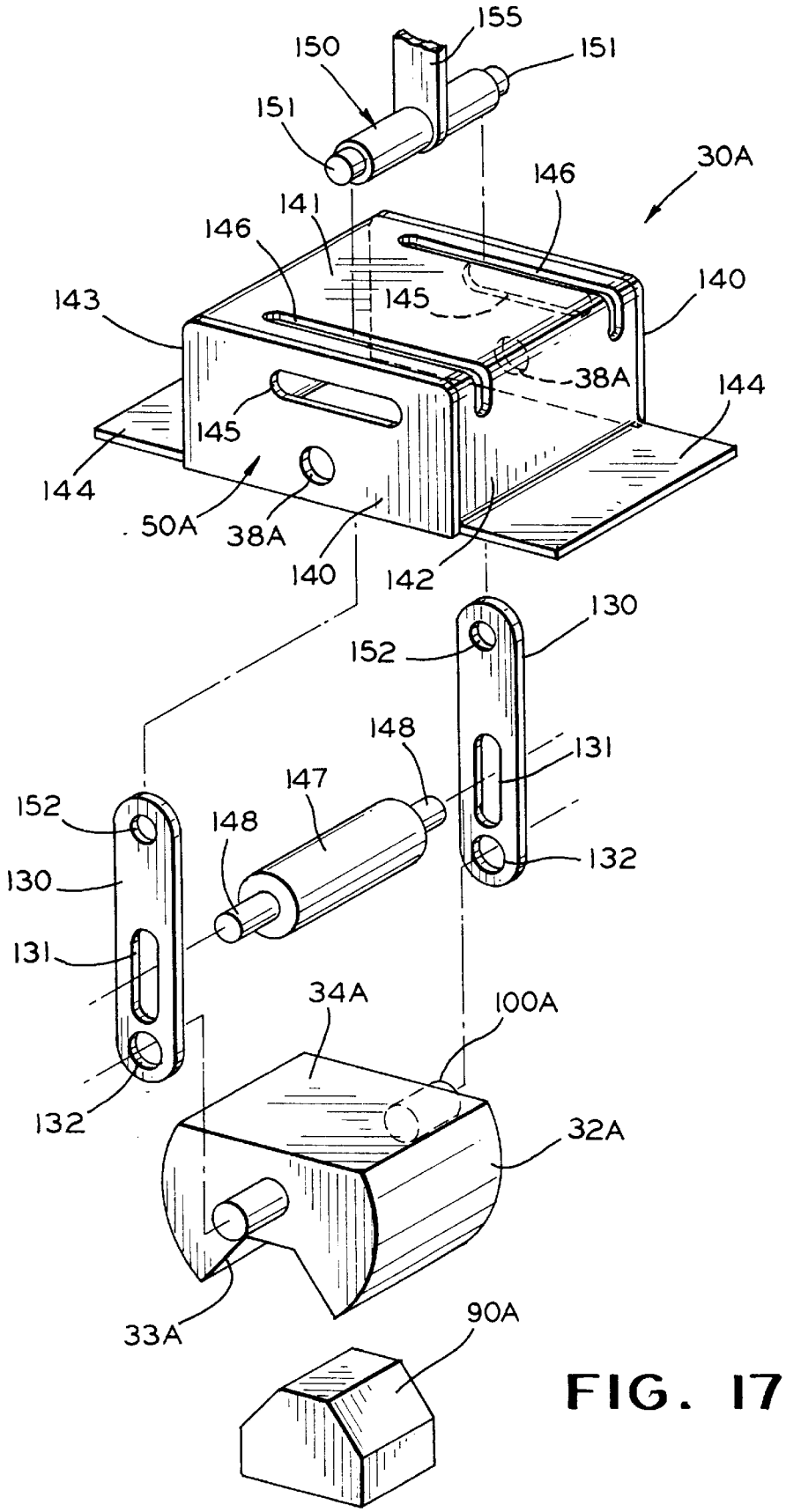
FIG. 17 is an exploded perspective view of the locking mechanism shown in FIG. 15.

Referring to FIG. 17 there is shown an exploded perspective view of one of the modified lock mechanisms 30A mounted in the door 120. The modified lock mechanism 30A has a modified housing 50A, including a pair of spaced apart side walls 140, a back wall 141, a top wall 142, a bottom wall 143, and a pair of mounting flanges 144. Provided in each of the side walls 140 is an elongated side wall slot 145. The side wall slots 144 may be provided in alignment with each other. Provided in the back wall 141 and a portion of the top wall 142 are a pair of identical spaced apart and aligned linkage accepting slots 146.

Also provided in the lock mechanism 30A are a pair of identical rotor links 130 which are rotatably mounted to the stub shafts 100A of the rotor using the shaft openings 132. The identical rotor links 130 are fixed to the shafts 100A in parallel, spaced apart, positions. A detent means 40A in the form of a transverse rod 147 having a pair of reduced shaft portions 148 is thereby constrained to travel in the elongated slots 131 when the rotor links 130 are rotated. The reduced shaft portion 148 will also pass through the elongated slots 131 in the links 130 and travel in the elongated side wall slots 145, as will be further described hereinafter. The rotor links 130 also pass through the linkage accepting slots 146 provided in the back and/or top wall 142 of the housing 50A. Connecting the ends of the rotor links 130 together is a connecting link 150 having a pair of identical reduced shaft portions 151 at both ends thereof. The length of the shaft portions 151 will be sufficient so that they will pass through the second shaft openings 152 in the rotor links 131. Since the rotor links 130 are in a fixed spacial relationship because they are mounted to the stub shafts 100A of the rotor 32A, it can be seen as the connecting link 150 is moved by the linkage 155, the detent means 40A will travel in the side wall slots 145 back and forth over the flat plane portion 34A to engage and disengage the rotor 32A.

Figure 18:
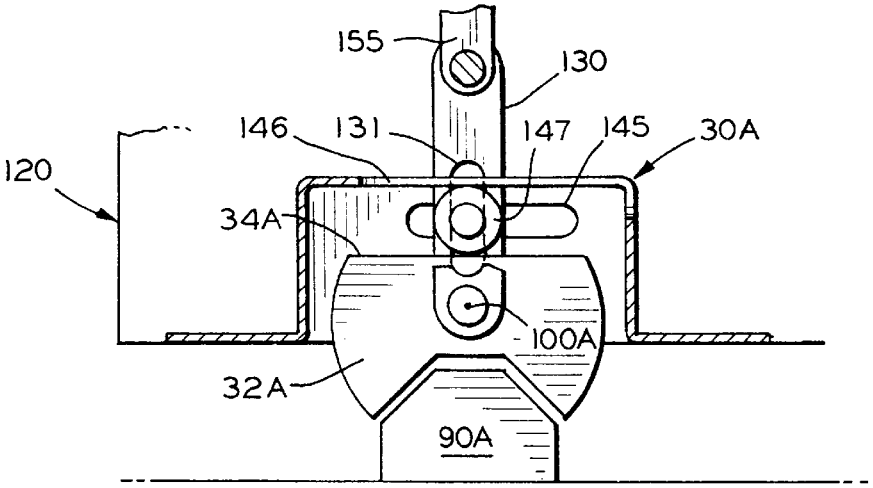
FIG. 18 is an elevational view, partly in section, showing the rotor of the lock mechanism of FIG. 17 in the door closed and unlocked position.
Figure 19:
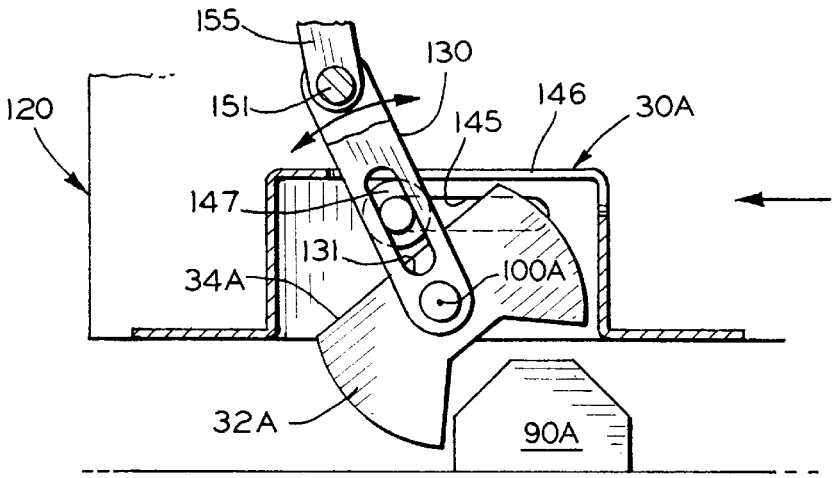
FIG. 19 is a view similar in part to FIG. 18 showing the lock mechanism in the door opened and unlocked position.
Figure 20:
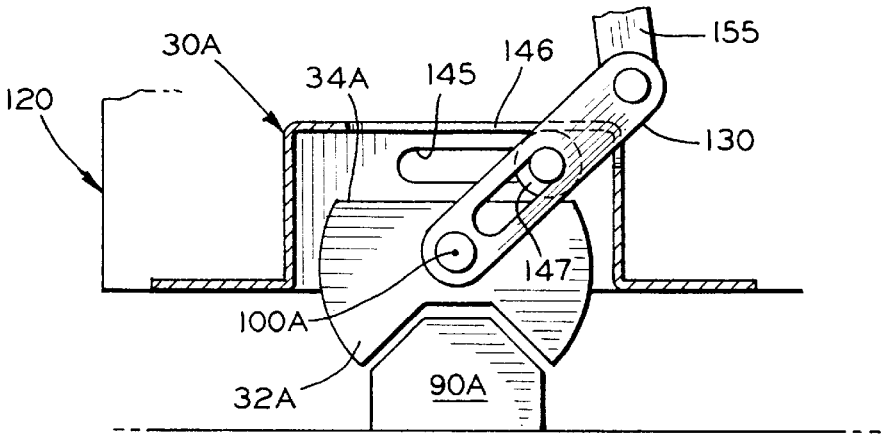
FIG. 20 is a view similar in part to FIG. 17 showing the rotor of the lock mechanism of FIG. 17 in the door closed and locked position.

Referring to FIGS. 18–20 the operation of this modification of my invention can be easily understood. Referring now to FIG. 18, my improved lock mechanism for sliding doors is shown in its unlocked position ready for the sliding door to be opened. The linkage 155, which may be compound, and may be of any type well known in the art to obtain the motions to be described, may be connected to any of many well known locking means. By operation of the locking means and suitable linkages, the link 130 has been moved to its vertical position in preparation for the opening of the door. Because the links 130 are rotatably mounted to the stub shafts 100A, a movement of the door 120 in the direction of the arrow, as shown in FIG. 19, not only causes the pawl 90A to move out of engagement with the rotor 32A, but causes the rotor 32A to rotate in a counterclockwise direction. This, in turn, causes the transverse rod 147 to be moved also in the direction of the movement of the door until the end of slot 145 is engaged. This provides sufficient clearance between the segmental recess 33A of the rotor 32A and the pawl 90A such that the door 120 can be continued to be moved until its fully open direction. Movement of the door to its closed position will again move the components of the locking mechanism 30A to the position shown in FIG. 18.

To lock the sliding door 122 it is necessary to operate the linkage 155 in a manner to cause the rotor links 130 to rotate in the clockwise direction until the transverse rod 147 contacts the other end of the elongated slot 145. It can be seen that any attempt to open the door 120 will cause the pawl 90A to contact the segmental recess 33A in the rotor 32A in an attempt to rotate the same. This will bring the flat face portion 34A into contact with the transverse rod 147 which will cause forces to act in the same manner as is diagramed in FIG. 7. Although it can be understood by those skilled in the art that one of such lock mechanisms 30A may be used in a sliding door provided that the door is restrained from movement in the upper position, the use of two lock mechanisms 30A in a 180° opposed relationship will cause the forces $F_H$ to be transmitted in a vertically upward and vertically downward direction against the top and the bottom of the door jam making it virtually impossible to force open the door.

Thus, it can be seen that the scope of the invention is very broad, and has many applications in the locking or latching field. It is believed that the fundamentally different principle of operation of my locking or latching mechanism is a great advance in the lock art. Thus by carefully studying problems in the locking and latching art, and discarding conventional solutions, I have provided a new and novel locking or latching mechanism.

What is claimed is:

1. A latch mechanism including:

a) a housing having a longitudinally extending axis, a pair of opposing side walls, and at least one pair of laterally spaced slots, one slot being located on one of said side walls and the other slot being located on the opposite side wall;

b) a cylindrical rotor having a longitudinally extending axis substantially parallel to and spaced from said axis of said housing, said rotor being mounted in said housing for clockwise or counterclockwise rotation about said longitudinally extending axis, said rotor further including a recess to engage a pawl, and a flat plane surface parallel to said longitudinally extending axis of said rotor;

c) detent means including at least one elongated horizontal member carried by said laterally spaced slots of said housing, said horizontal member being located transversely to said longitudinal axis of said rotor and substantially parallel to said flat plane surface of said rotor;

d) a lock shaft carried by said housing and rotatably mounted therein; and e) a linkage means connecting said elongated member and said lock shaft, whereby the rotation of said lock shaft causes said linkage means to rotate and carry said elongated member into and out of engagement or close proximity with said flat plane surface to selectively permit the rotation of said rotor or to block the rotation of said rotor.

2. The device defined in claim 1, wherein:

said housing carries two opposed pairs of slots; and an elongated member is mounted in each of the slots for movement into and out of close proximity with said flat plane surface of said rotor upon rotation of said lock shaft.

3. The device defined in claim 2, and including a lock means connected to said lock shaft to maintain said detent means in a predetermined desired position.

* * * * *